US007557791B2

(12) United States Patent
Tokumura

(10) Patent No.: US 7,557,791 B2
(45) Date of Patent: Jul. 7, 2009

(54) DRIVING CIRCUIT FOR ELECTRO-OPTICAL DEVICE, METHOD OF DRIVING ELECTRO-OPTICAL DEVICE, ELECTRO-OPTICAL DEVICE, AND ELECTRONIC APPARATUS

(75) Inventor: Toshiaki Tokumura, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 658 days.

(21) Appl. No.: 11/176,662

(22) Filed: Jul. 8, 2005

(65) Prior Publication Data

US 2006/0012555 A1 Jan. 19, 2006

(30) Foreign Application Priority Data

Jul. 15, 2004 (JP) ..... 2004-208427

(51) Int. Cl.
*G09G 3/36* (2006.01)

(52) U.S. Cl. ..... 345/98

(58) Field of Classification Search ..... 345/55, 345/90–91, 87, 89, 96, 97–100, 104, 204, 345/209, 214, 690; 359/242, 245; 348/790, 348/792

See application file for complete search history.

(56) References Cited

U.S. PATENT DOCUMENTS

| | | | | |
|---|---|---|---|---|
| 5,734,379 | A * | 3/1998 | Natsumi et al. | 345/211 |
| 6,509,887 | B1 | 1/2003 | Kondoh et al. | |
| 6,567,065 | B1 | 5/2003 | Kondoh et al. | |
| 7,102,603 | B2 | 9/2006 | Kondoh et al. | |
| 7,196,697 | B2 * | 3/2007 | Yamazaki | 345/204 |
| 7,196,699 | B1 * | 3/2007 | Kubota et al. | 345/211 |
| 7,265,742 | B2 | 9/2007 | Iisaka | |
| 7,362,321 | B2 * | 4/2008 | Kumada et al. | 345/209 |
| 2007/0063953 | A1 | 3/2007 | Iisaka | |

FOREIGN PATENT DOCUMENTS

| | | |
|---|---|---|
| JP | A-05-088641 | 4/1993 |
| JP | 2605261 B2 | 2/1997 |
| JP | A-09-127920 | 5/1997 |
| JP | A-2000-029433 | 1/2000 |
| JP | A-2004-177930 | 6/2004 |
| WO | WO98/59274 | 12/1998 |

* cited by examiner

*Primary Examiner*—Abbas I Abdulselam
(74) *Attorney, Agent, or Firm*—Oliff & Berridge PLC

(57) ABSTRACT

A driving circuit for an electro-optical device, that drives an electro-optical device having a plurality of data lines and a plurality of scanning lines extending so as to cross each other and a plurality of pixel units connected to the scanning lines and the data lines to form a display surface, includes a memory into/from which image signals are written/read, such that the plurality of pixel units perform grayscale display, a scanning line driving unit that selects the scanning lines and supplies scanning signals to the selected scanning lines, a data line driving unit that selects the data lines and supplies the image signals read out from the memory to the selected data lines, and a control unit that controls an operation of at least one of the scanning line driving unit and the data line driving unit, such that at least one of a selection sequence of the plurality of scanning lines and a selection sequence of the plurality of data lines is inverted at a predetermined inversion cycle, and that controls writing and reading of the image signals in the memory, such that the image signals written into the memory are read out in a state in which an arrangement sequence of the image signals is inverted at the inversion cycle.

5 Claims, 16 Drawing Sheets

DRIVING CIRCUIT FOR ELECTRO-OPTICAL DEVICE, METHOD OF DRIVING ELECTRO-OPTICAL DEVICE, ELECTRO-OPTICAL DEVICE, AND ELECTRONIC APPARATUS

BACKGROUND OF THE INVENTION

1. Technical Field

The present invention relates to a driving circuit for an electro-optical device mounted on an electro-optical device, such as a liquid crystal device, to a method of driving an electro-optical device, to an electro-optical device, and to an electronic apparatus having an electro-optical device.

2. Related Art

Generally, a driving circuit is incorporated into a substrate of an electro-optical device, such as a liquid crystal device, so as to function as a data line driving circuit for driving data lines or a scanning line driving circuit for driving scanning lines. During operation, image signals are supplied to a row of pixel units, which is selected through vertical scanning by a scanning line driving unit, via the data lines from a-data line driving unit, such that data is written into the pixel units.

In a driving method, various methods for reducing display defects which occur during driving have been conceived. For example, in order to prevent flicker on a display screen and burning or aging of the liquid crystal, a polarity inversion driving method has been generally adopted. For example, in a field inversion driving method or a frame inversion driving method, the polarity of an image signal is inverted for each field or frame. In addition, in a row inversion driving method or a column inversion driving method, the polarity of an image signal is inverted for each row or column, while being inverted for each frame or field.

In order to prevent the occurrence of flicker, a method has been suggested in which image signals corresponding to one frame are stored in a memory and the time axis is compressed and read out, thereby increasing the driving frequency (for example, see Japanese Patent No. 2605261).

However, regarding display irregularity caused by the difference in writing characteristics in the horizontal direction and the vertical direction of the screen, another method is needed, in addition to the above-described method. More particularly, 'the difference in writing characteristics' means the difference in the range or frequency of occurrence of ghosting in the horizontal direction or dark spots caused by the inclination of display luminance in the vertical direction, due to the difference in characteristics of thin film transistors (hereinafter, referred to as TFTS) used for sampling the image signals.

SUMMARY

An advantage of the invention is that it provides a driving circuit for an electro-optical device capable of performing uniform display, a method of driving an electro-optical device, an electro-optical device, and an electronic apparatus having an electro-optical device.

According to a first aspect of the invention, there is provided a driving circuit for an electro-optical device which drives an electro-optical device having a plurality of data lines and a plurality of scanning lines extending so as to cross each other and a plurality of pixel units connected to the scanning lines and the data lines to form a display surface. The driving circuit for an electro-optical device includes a memory into/from which image signals are written/read, the image signals being for performing gray scale display in the plurality of pixel units, a scanning line driving unit that selects the scanning lines and supplies scanning signals to the selected scanning lines, a data line driving unit that selects the data lines and supplies the image signals read out from the memory to the selected data lines, and a control unit that controls an operation of at least one of the scanning line driving unit and the data line driving unit, such that at least one of a selection sequence of the plurality of scanning lines and a selection sequence of the plurality of data lines is inverted at a predetermined inversion cycle, and that controls writing and reading of the image signals in the memory, such that the image signals written into the memory are read out in a state in which an arrangement sequence of the image signals is inverted at the inversion cycle.

In accordance with the first aspect of the invention, when driving, one or both of the selection sequence of the scanning lines and the selection sequence of the data lines are inverted at the predetermined cycle. The 'selection' described herein means that one pixel unit is selected to be supplied with the image signal in a so-called matrix driving method. A voltage is applied to the selected scanning line and a row of pixels is selected. In addition, the image signal is supplied to the selected data line, such that a writing operation is performed with respect to one pixel unit among the row of pixels.

Specifically, one or both of a direction in which the scanning signals are supplied to the scanning lines, that is, a vertical scanning direction (hereinafter, referred to as 'a vertical scanning direction') and a direction in which the image signals are supplied to the data lines, that is, a horizontal scanning direction (hereinafter, referred to as 'a horizontal scanning direction') are inverted at the predetermined cycle. For example, the data line driving unit supplies the image signals in a sequence from the left side of the screen to the right side thereof in an odd-numbered screen and supplies the image signals in a sequence from the right side of the screen to the left side thereof in an even-numbered screen. In addition, the scanning line driving unit sequentially supplies the scanning signals in a sequence from the upper side of the screen to the lower side thereof in the odd-numbered screen and sequentially supplies the scanning signals in a sequence from the lower side of the screen to the upper side thereof in the even-numbered screen. That is, the horizontal scanning direction or the vertical scanning direction is inverted for each screen.

The directions in which the signals are supplied from one or both of the scanning line driving unit and the data line driving unit are controlled by the control unit to be inverted. At this time, the control unit inverts the signal supply direction at the predetermined inversion cycle, for example, for each screen. For this reason, the difference in ghost in a horizontal direction of the screen or dark spots in a vertical direction thereof are averaged on the time axis, thereby performing a uniform display.

Here, the control unit may be constructed as a controller that controls the operation of the entire driving circuit or may be additionally provided in the driving unit as an inversion operation control unit. In addition, a portion that controls the inversion operation of the signal supply direction and a portion that controls the inversion operation in the memory may be separately provided. In addition, 'the inversion cycle' may be suitably set within a range in which the inversion of the signal supply direction may be actually performed, for example, in terms of frames, fields, or lines.

When the signal supply direction is inverted, the image signal supply sequence needs to be changed so as to perform a proper display. The image signals corresponding to the pixels are arranged in a sequence according to a typical scanning direction. Therefore, the driving circuit according to the first aspect of the invention is constructed such that the arrangement sequence of the image signals is inverted according to the inversion of the signal supply direction. More specifically, when the image signals are written in the memory or read out from the memory, the sequence of the image signals may be changed. As a result, the arrangement sequence of the image signals can correspond to the scanning direction of the screen, thereby displaying an image favorably and constantly. A memory having at least a memory space that the image signals corresponding to the inversion cycle can be stored may be used. However, in this case, the writing or reading direction needs to be inverted according to the inversion cycle. For example, the image signals to be inverted and the image signals not to be inverted may be written into separate memories. In this case, the operation directions of the memories are different from each other. In one memory, the writing or reading direction is constantly inverted, while, in the other memory, the writing or reading direction is not inverted. In addition, the image signals may be read out in the inverted arrangement sequence and may be moved into the other memory.

As described above, in accordance with the first aspect of the invention, since one or both of the horizontal scanning direction and the vertical scanning direction are inverted at the predetermined inversion cycle, 'the difference in writing characteristics' caused by the fixed horizontal scanning direction or vertical scanning direction can be equalized, thereby performing a uniform display. Further, since the arrangement sequence of the image signals is inverted according to the inversion of the scanning direction, a favorable image can be displayed.

It is preferable that at least one of the scanning line driving unit and the data line driving unit sequentially outputs, from respective stages, transfer signals for controlling timings at which the scanning signals and the image signals are supplied and has a shift register in which a driving sequence of the respective stages is inverted based on a direction control signal. Further, the control unit may input the direction control signal to the shift register at the inversion cycle so as to control a signal supply operation of at least one of the scanning line driving unit and the data line driving unit.

In this case, the driving direction of the shift register in at least one of the scanning line driving unit and the data line driving unit is in a forward direction or in a backward direction, so that the signal supply direction can be inverted. The driving direction of the shift register is generally fixed. However, a shift register start signal is inputted to any one of a left end and a right end of the shift register, so that the driving direction can be changed in a left direction or in a right direction. The direction control signal may be a signal which determines whether the input destination of the shift register start signal is the left end of the shift register or the right end. Further, the direction control signal may be the shift register start signal itself.

As such, by controlling the driving direction of the built-in shift register of the scanning line driving unit or the data line driving unit, the scanning direction can be easily controlled.

It is preferable that the inversion cycle is expressed in one-screen display periods.

In this case, at least one of the horizontal scanning direction and the vertical scanning direction is inverted for each screen or for multiple screens (that is, whenever the image signals corresponding to one field or multiple fields are supplied). However, in this case, the inversion cycle is not a field period depending on a length of each image signal, but the one-screen display period. For example, when the writing operation is performed at a double speed and the same image is repeatedly written and displayed for one frame period, even though the supplied signal is the same signal, the signal supply direction is inverted whenever the image signals corresponding to one frame are supplied.

In this case, since the inversion cycle is expressed in one-screen display periods, a vertical synchronizing signal can be used as it is for inversion control.

It is preferable that, when a scanning signal supply direction is inverted, the inversion cycle is expressed in horizontal scanning periods.

In this case, the image signal supply direction is inverted for each line or for multiple lines. Therefore, the dark spots in the vertical direction are equalized for every screen, so that a better uniform display can be performed. Further, in this case, since the inversion cycle is expressed in horizontal scanning periods, a horizontal synchronizing signal can be used as it is for inversion control.

It is preferable that the scanning line driving unit and the data line driving unit supply the image signals corresponding to one screen to the respective pixel units in each unit period, which is obtained by dividing a one-screen display period, and drives the respective pixel units multiple times in the one-screen display period.

In this case, each pixel unit is driven multiple times in the screen display period. That is, each pixel unit is driven at a double speed or an n-times speed (where n is an integer of 2 or more). More particularly, the image signals corresponding to one field or one frame written into a buffer memory are read out from the buffer memory at the double speed or n-times speed in the period corresponding to one field or one frame. Further, the image signals corresponding to one screen (for example, one field or one frame) are repeatedly written n times into the respective pixel at a cycle shorter than one field or one frame. At this time, regarding one pixel unit, in the same image display period, the same image signal is repeatedly supplied for each unit period.

In a double speed driving method, since a driving frequency is high, it is possible to suppress flicker or crosstalk on a display image. Similarly, even though display irregularities occur due to 'supply direction inversion driving', it cannot be perceived. In addition, the double speed driving method has an advantage in that responsibility to the voltage application to liquid crystal can be improved, that is, a luminance value can be increased up to a value according to the image signal. In addition, since the voltage application time required for applying the voltage to liquid crystal once becomes short, aging or burning of liquid crystal can be reduced.

It is preferable that the memory has at least two frame memories, and the same image signals corresponding to one screen are written into the two frame memories. Further, the two frame memories may be controlled by the control unit, such that one of the frame memories functions as a forward memory from which the image signals are read out in a state in which the arrangement sequence of the image signals is in a forward direction and the other frame memory functions as a backward memory from which the image signals are read out in a state in which the arrangement sequence of the image signals is in a backward direction.

In the double speed driving method, a method is adopted, in which, typically, two frame memories are prepared as buffers, the image signals of the same frame are respectively written into the frame memories, and the image signals are read out from the frame memories from the respective frame memories with a time shift. Therefore, one of the two frame memories functions as the forward memory and the other frame memory functions as the backward memory. The forward memory is used such that data is read out in the same direction as the writing direction. The backward memory is used such that data is read out in a direction opposite to the writing direction. Therefore, regarding two screens to be displayed for one frame period, scanning on one screen is performed in a normal direction and scanning on the other screen is performed in a predetermined inversion direction.

By using the frame memories as described above, 'the signal supply direction inversion driving method' according to the first aspect of the invention can be applied to the configuration for double speed driving method.

According to a second aspect of the invention, an electro-optical device includes the above-mentioned driving circuit for an electro-optical device (including various configurations), a plurality of data lines and a plurality of scanning lines, and a plurality of pixel units.

In accordance with the second aspect of the invention, since the electro-optical device includes the above-mentioned driving circuit for an electro-optical device, a uniform display can be performed. The electro-optical device can implement various display devices, such as, liquid crystal devices, organic electroluminescent devices, electrophoretic devices, such as electronic papers, and display devices using electron emission elements (Field Emission Display and Surface-Conduction Electron-Emitter Display).

According to a third aspect of the invention, an electronic apparatus includes the above-mentioned electro-optical device (including various configurations).

In accordance with the third aspect of the invention, the electronic apparatus includes the above-mentioned electro-optical device. The electro-optical device has the above-mentioned driving circuit of an electro-optical device and thus a uniform display can be performed. The electronic apparatus according to the third aspect of the invention may be applied to various electronic apparatuses, such as, projection-type display devices, television sets, cellular phones, electronic organizers, word processors, view-finder-type or monitor-direct-view-type video tape recorders, workstations, video phones, POS terminals, and touch panels.

According to a fourth aspect of the invention, there is provided a method of driving an electro-optical device which is applied to an electro-optical device having a plurality of data lines and a plurality of scanning lines extending so as to cross each other and a plurality of pixel units connected to the scanning lines and the data lines to form a display surface. The method of driving an electro-optical device includes reading image signals written into a memory into/from which the image signals are written/read out, such that the plurality of pixel units perform grayscale display, while an arrangement sequence of the image signals is inverted at a predetermined inversion cycle, inverting at least one of a selection sequence of the plurality of scanning lines and a selection sequence of the plurality of data lines at the predetermined inversion cycle, and supplying scanning signals to the plurality of scanning lines and supplying the image signals to the plurality of data lines to write the image signals into the plurality of pixel units.

According to this aspect, as described in the above-mentioned driving circuit of an electro-optical device, the display difference in one of the horizontal direction of the screen and the vertical direction or both of them is alleviated by the supply direction inverting process to invert the signal supply direction (that is, one of the horizontal scanning direction or the vertical scanning direction and both of them). In addition, by performing the data arrangement inverting process for inverting the arrangement sequence of the image signal so as to correspond to the inversion of the supply direction, even though the image signal is written in the pixel unit in a different direction from a common direction, a proper image is displayed.

Therefore, a uniform display can be performed with a favorable image display.

The effects and advantages of the invention will be apparent from embodiments described below.

BRIEF DESCRIPTION OF THE DRAWINGS

The invention will be described with reference to the accompanying drawings, wherein like numbers reference like elements, and wherein.

DESCRIPTION OF THE EMBODIMENTS

Hereinafter, preferred embodiments of the invention will be described with reference to the accompanying drawings. In the embodiments described below, an electro-optical device according to the invention is applied to a liquid crystal device.

1: First Embodiment

An electro-optical device according to a first embodiment of the invention will be described with reference to FIGS. 1 to 8B.

1-1: Configuration of Liquid Crystal Device

Figure 1:
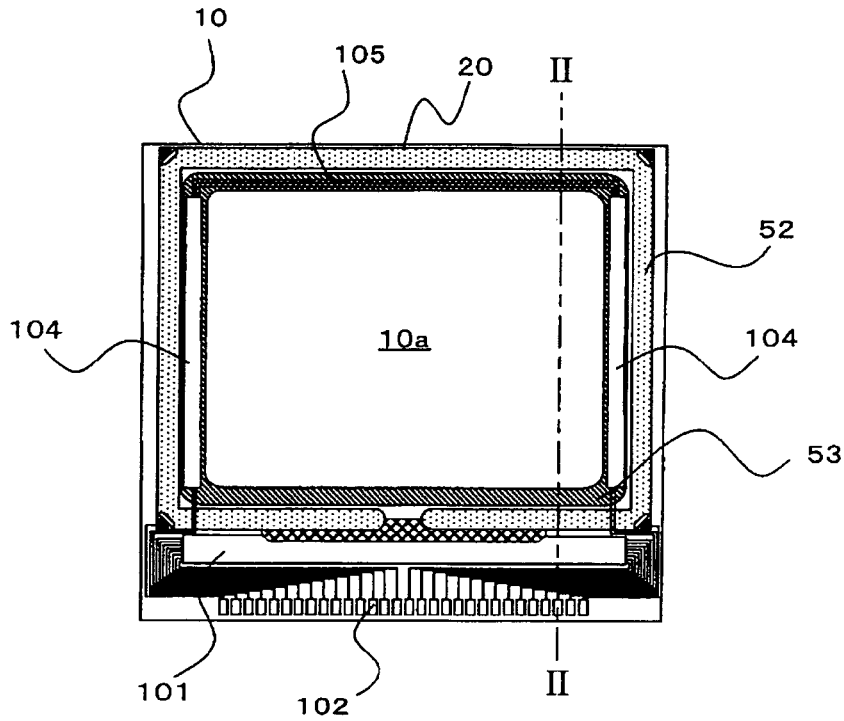
FIG. 1 is a plan view showing an entire configuration of an electro-optical device.
Figure 2:
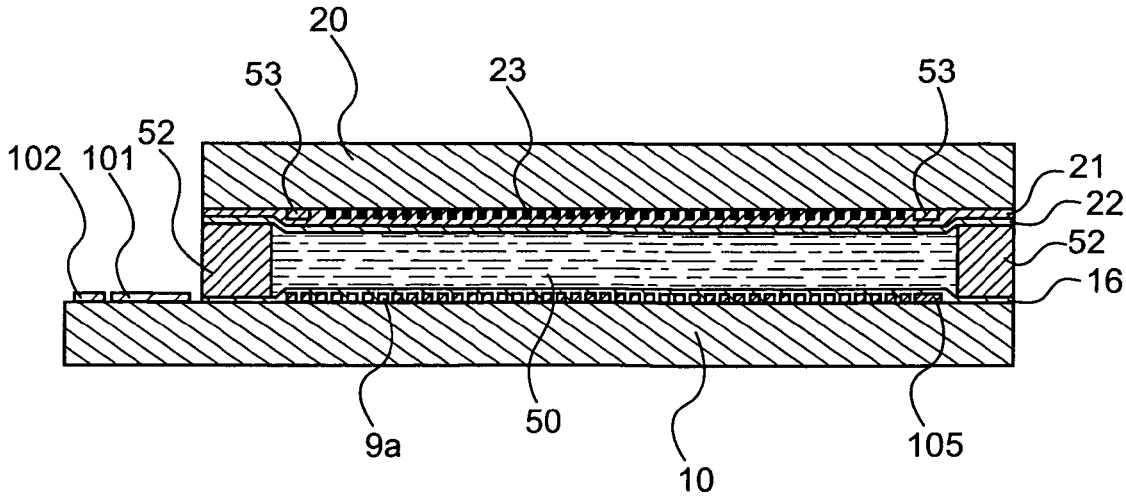
FIG. 2 is a cross-sectional view taken along the line II-II of FIG. 1.
Figure 3:
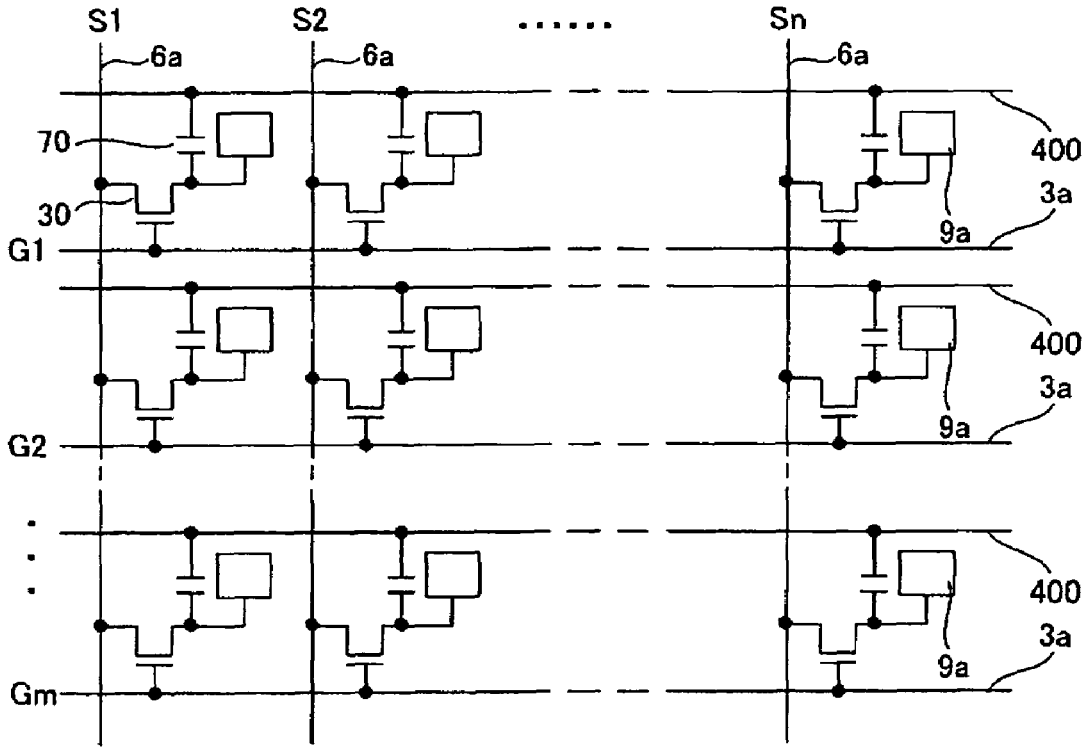
FIG. 3 is an equivalent circuit diagram showing various elements and wiring lines in a plurality of pixel units which are formed in a matrix shape to form an image display region of an electro-optical device.
Figure 4:
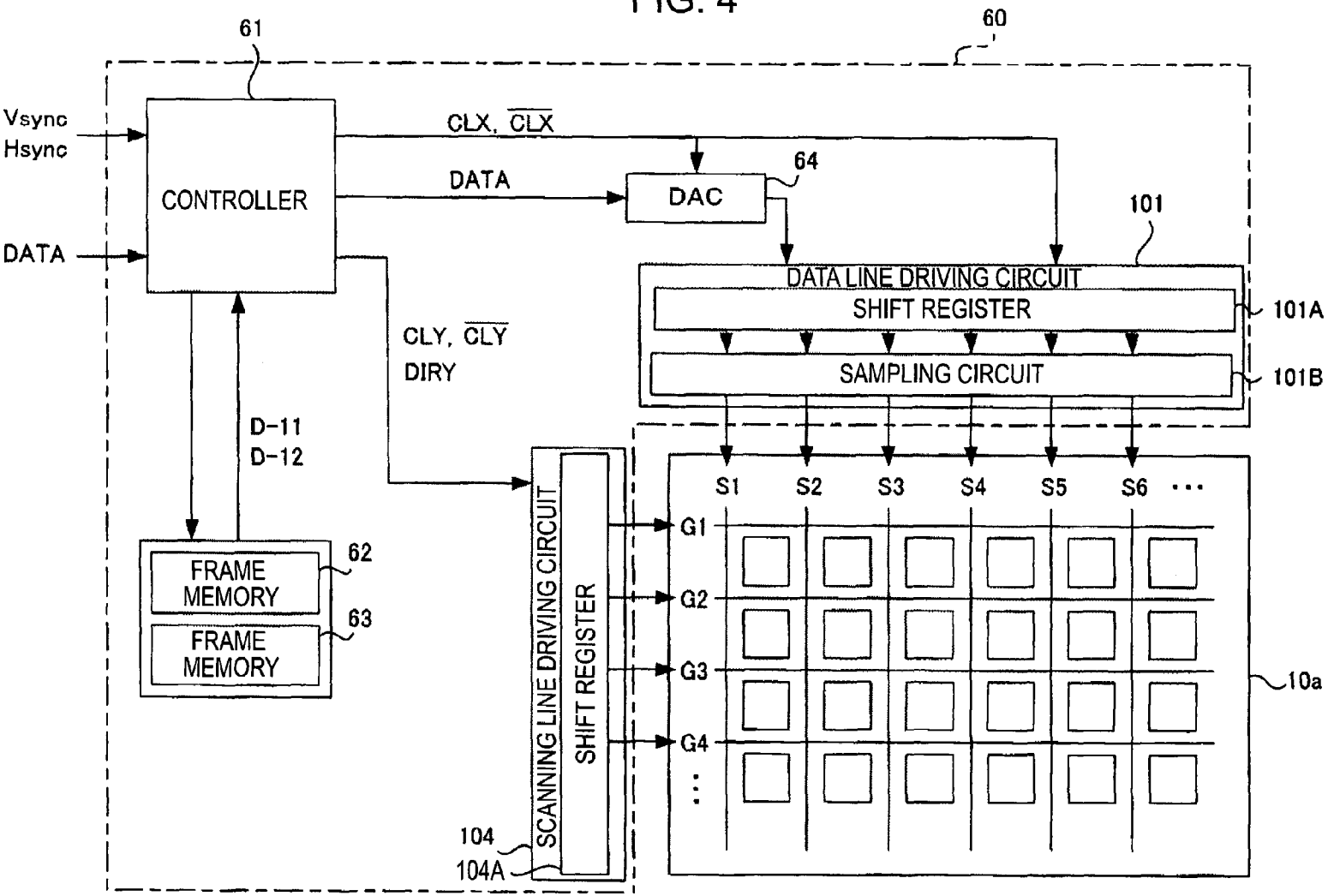
FIG. 4 is a block diagram showing a driving system for an electro-optical device according to a first embodiment of the invention.

First, the configuration of a liquid crystal device, which is an electro-optical device according to the present embodiment, will be described with reference to FIGS. 1 to 4. FIG. 1 is a plan view showing an external configuration of the liquid crystal device. FIG. 2 is a cross-sectional view taken along the line II-II of FIG. 1. FIG. 3 is an equivalent circuit diagram of pixel units in the liquid crystal device, and FIG. 4 is a block diagram of a driving system including a driving circuit unit.

In FIG. 1, the liquid crystal device has a configuration in which a liquid crystal layer 50 is interposed between a TFT array substrate 10 and a counter substrate 20 arranged to face each other. That is, as one specific example of the invention, in the liquid crystal device, a TFT active-matrix driving method with a built-in driving circuit is adopted. An image display region 10*a* on which images are displayed is defined by a frame light-shielding film 53. The TFT array substrate 10 and the counter substrate 20 are bonded by a sealing member 52 in the periphery of the image display region 10*a*.

In a peripheral region located in the periphery of the image display region 10*a*, a data line driving circuit 101 and two scanning line driving circuits 104, which are connected to each other through wiring lines, are arranged. In addition, in the peripheral region, a plurality of external connecting terminals 102 are arranged along one side of the TFT array substrate 10. The liquid crystal device is supplied with video signals or the like from outside through the external connecting terminals 102.

In FIG. 2, on the TFT array substrate 10, pixel electrodes 9*a* are provided on pixel switching TFTs or wiring lines, such as scanning lines and data lines. Further, an alignment film 16 is formed just above the pixel electrodes 9*a*. On the other hand, on the counter substrate 20, a counter electrode 21 is formed via a stripe-shaped light-shielding film 23. An alignment film 22 is formed on the counter electrode 21. The liquid crystal layer 50 is formed by injecting liquid crystal into a space which is defined by bonding the TFT array substrate 10 and the counter substrate 20 via the sealing member 52. The alignment state of liquid crystal in the liquid crystal layer 50 is changed according to an electric field applied between the pixel electrodes 9*a* and the counter electrode 21. When the electric field is not applied, the liquid crystal layer 500 has an alignment state defined by the alignment film 16 and the alignment film 22.

Moreover, on the TFT array substrate 10, in addition to the data line driving circuit 101 and the scanning line driving circuits 104, a sampling circuit that samples image signals on image signal lines so as to supply the sampled image signals to the data lines, a precharge circuit that supplies a precharge signal having a predetermined voltage level to the plurality of data lines prior to the image signals, and a test circuit that tests the quality and defect of the liquid crystal device during manufacturing or at the time of shipping may be formed.

As shown in FIG. 3, in the image display region 10*a*, the plurality of scanning lines 3*a* and the plurality of data lines 6*a* are arranged so as to cross each other, and pixel units which are selected by the respective scanning lines 3*a* and the respective data lines 6*a* are provided. In each pixel unit, a TFT 30, the pixel electrode 9*a*, and a storage capacitor 70 are provided. The TFTs 30 are provided for selectively applying image signals S1, S2, . . . , and Sn, which are supplied from the data lines 6*a*, to the selected pixels. A gate of the TFT 30 is connected to the scanning line 3*a*, a source thereof is connected to the data line 6*a*, and a drain thereof is connected to the pixel electrode 9*a*. The pixel electrode 9*a* forms a liquid crystal capacitor with the counter electrode 21, and applies the input image signals S1, S2, . . . , and Sn to the pixel units to be held therein for a constant period. One electrode of the storage capacitor 70 is connected to the drain of the TFT 30 in parallel with the pixel electrode 9*a* and the other electrode thereof is connected to a capacitor wiring line 400 having a fixed potential so as to have a constant potential.

The liquid crystal device employs, for example, a TFT active-matrix driving method and applies scanning signals G1, G2, . . . , G2*m* to the scanning lines 3*a* in a sequence described below through the scanning line driving circuits 104 (see FIG. 1). Then, with respect to a selected row of pixel units in the horizontal direction, in which the TFTs 30 are turned on, the image signals S1, S2, . . . , and Sn are applied through the data lines 6*a* from the data line driving circuit 101 (see FIG. 1). As such, the image signals are supplied to the pixel electrodes 9*a* corresponding to the selected pixels.

At this time, the image signals S1, S2, . . . , and Sn may be line-sequentially supplied to the data lines 6*a* or may be supplied to the plurality of data lines 6*a* (for example, for each group) at the same timing. In the present embodiment, as an example, a method in which the image signals are line-sequentially supplied is adopted.

Since the TFT array substrate 10 is arranged to face the counter substrate 20 with the liquid crystal layer 50 interposed therebetween (see FIG. 2), an electric field is applied to the liquid crystal layer 50 for every divided pixel unit described above, the amount of transmitted light between both substrates is controlled for every pixel unit, and the image is thus displayed with a grayscale level. At this time, with the storage capacitor 70, the image signals held in the respective pixel units are prevented from leaking.

In FIG. 4, a driving unit 60 of the liquid crystal device according to the present embodiment has a controller 61, frame memories 62 and 63 for two screens, and a digital-analog (DA) converter 64, in addition to the data line driving circuit 101 and the scanning line driving circuit 104.

The controller 61 is supplied with a vertical synchronizing signal Vsync, a horizontal synchronizing signal Hsync, and an image signal DATA. The controller 61 has a function for controlling operation timings of the respective constituents based on the vertical synchronizing signal Vsync and the horizontal synchronizing signal Hsync. In particular, the controller 61 is a specific example of 'a control unit' according to the invention, and has a function for controlling the signal supply direction of the scanning line driving circuit 104 and a function for controlling the reading direction of the image signal DATA in the frame memories 62 and 63.

Moreover, the image signal DATA is a digital signal indicating the luminance of respective colors including red (R), green (G), and blue (B), like an RGB signal, before being written in at least the frame memories 62 and 63. For this reason, though not shown, a signal processing circuit, such as an RGB matrix circuit, may be additionally provided in front of the controller 61, if necessary. In addition, the image signal DATA is a non-interlaced signal or a non-interlaced signal obtained by performing field interpolation on a 2:1 interlaced signal before being transmitted to the frame memories 62 and 63.

The frame memories 62 and 63 are driven such that for every frame, alternately, one frame memory temporarily stores the image signals DATA corresponding to one frame inputted from the outside, while the other frame memory outputs the stored image signals DATA as display signals. Here, the frame memories 62 and 63 have configurations such that the image signals DATA are stored in line data. The frame memories 62 and 63 are used as buffers for transmitting the image signals at double speed (2×) by compressing the time axis and are used to change the arrangement sequence of the image signals DATA.

In addition, the DA converter 64 has a function that converts the image signals DATA read out from the frame memories 62 and 63 into analog signals and outputs them to the data line driving circuit 101.

The data line driving circuit 101 includes a shift register 101A and a sampling circuit 101B. The data line driving circuit 101 samples and clocks transfer signals sequentially generated by the shift register 101A and signals obtained by shaping the transfer signals again, based on a clock signal CLX and an inversion clock signal CLX' transmitted from the controller 61. Further, the data line driving circuit 101 samples the analog image signals inputted from the DA converter 64. In addition, the data line driving circuit 101 is operated such that the image signals S1, S2, . . . , and Sn obtained through sampling are applied to the corresponding data lines 6*a*.

In the scanning line driving circuit 104, a built-in shift register 104A sequentially generates the scanning signals G1, G2, . . . , and Gm according to a clock signal CLY and an inversion clock signal CLY' inputted from the controller 61, such that standard line sequential horizontal scanning can be performed. However, the scanning line driving circuit 104 according to the present embodiment is constructed such that an output sequence of the scanning signals from the shift register 104A is changed according to a direction signal DIRY. The direction signal DIRY is a control signal for changing the scanning signal supply direction to a direction from an upper side of the arranged scanning lines 3*a* to a lower side thereof or a direction from the lower side of the scanning lines 3*a* to the upper side thereof. In the scanning line driving circuit 104, a shift register start signal (not shown) is inputted to the shift register according to the value of the direction signal DIRY. The shift register 104A is driven from the upper end to the lower end when the shift register start signal is inputted to the upper end and is driven from the lower end to the upper end when the shift register start signal is inputted to the lower end. Since the output sequence of the scanning signals corresponds to the driving direction of the shift register 104A, the scanning line driving circuit is constructed as described above, so that the controller 61 can control the output sequence of the scanning signals to the scanning lines 3*a* from the scanning line driving circuit 104.

1-2: Method of Driving Liquid Crystal Device

Figure 5:
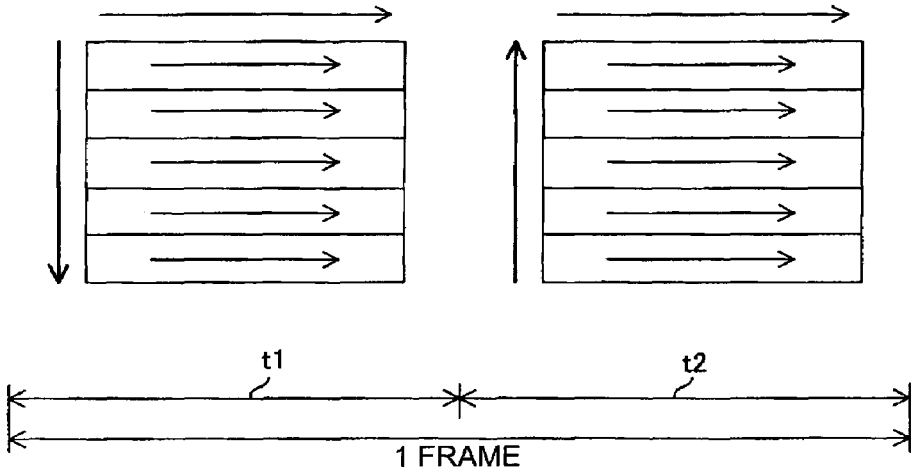
FIG. 5 is a diagram illustrating a method of driving an electro-optical device according to the first embodiment of the invention.
Figure 6:
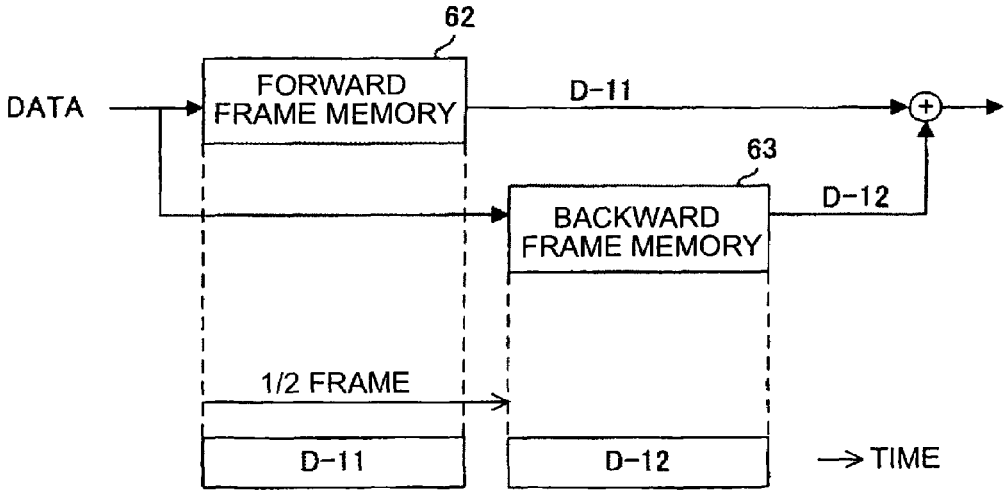
FIG. 6 is a diagram illustrating the method of driving an electro-optical device according to the first embodiment of the invention.
Figure 7:
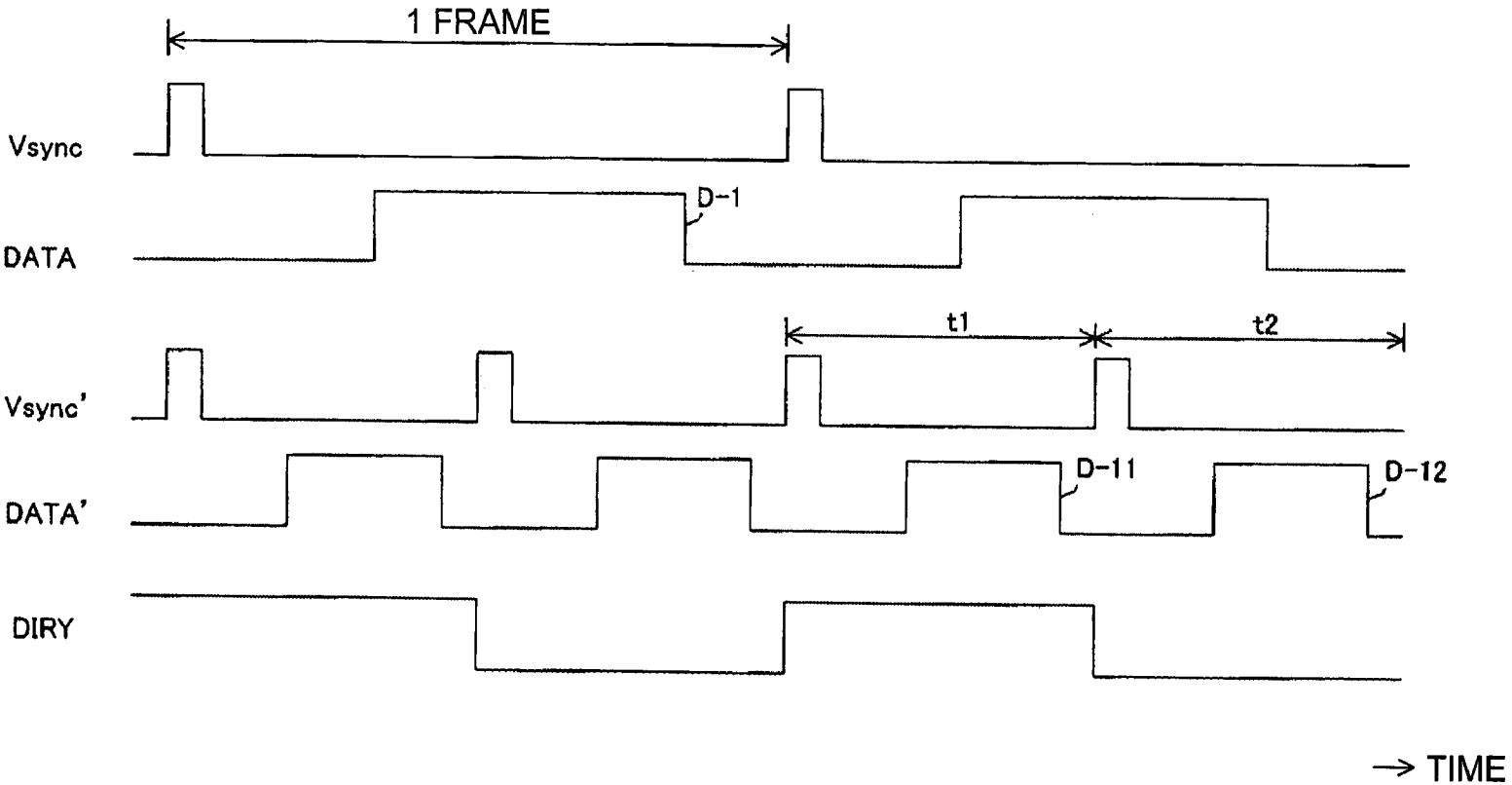
FIG. 7 is a timing chart illustrating the method of driving an electro-optical device according to the first embodiment of the invention.
Figure 8A:
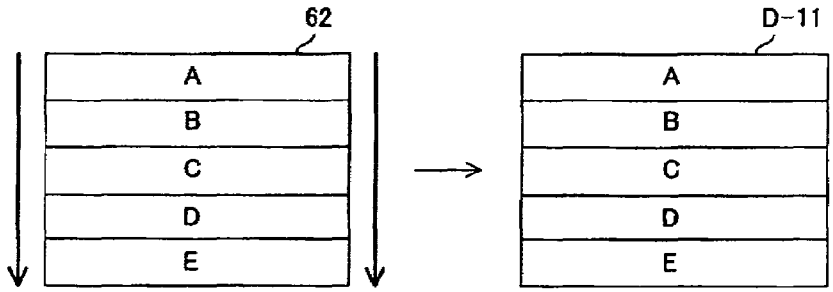
FIG. 8A is a diagram illustrating the method of driving an electro-optical device according to the first embodiment of the invention.
Figure 8B:
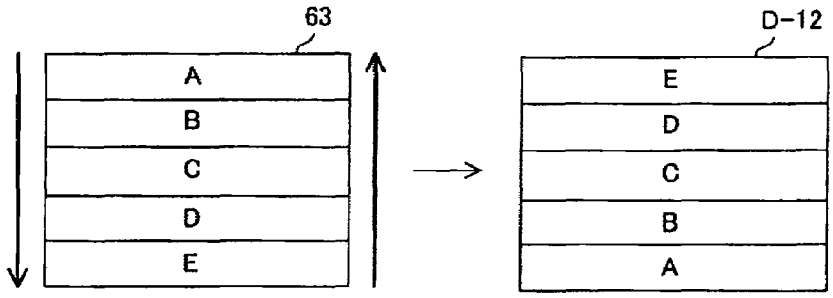
FIG. 8B is a diagram illustrating the method of driving an electro-optical device according to the first embodiment of the invention.

A method of driving a liquid crystal device will be described with reference to FIGS. 5 to 8B. FIG. 5 is a diagram conceptually illustrating the method of driving a liquid crystal device according to the present embodiment. FIG. 6 is a diagram conceptually showing the operation sequence by the frame memories 62 and 63. FIG. 7 is a timing chart illustrating the method of driving a liquid crystal device according to the present embodiment. FIGS. 8A and 8B are diagrams showing a sequence of a signal inversion process by the frame memories 62 and 63.

As shown in FIG. 5, according to the present embodiment, a display period corresponding to one screen is set to a half of a general frame period. That is, the data line driving circuit 101 and the scanning line driving circuit 104 are driven at double speed (2×), and the writing operation of the image signals is performed for two screens in one frame period. Moreover, in the following description, half of one frame period, that is, a period required for writing a screen once, is referred to as 'a unit period'. In addition, according to the present embodiment, a vertical scanning direction is inverted for each screen. More particularly, in a first unit period t1 of one frame period, the horizontal scanning is sequentially performed in a general direction from the upper side of the screen to the lower side thereof. However, in a unit period t2 subsequent to the unit period t1, the horizontal scanning is sequentially performed in a direction from the lower side of the screen to the upper side thereof.

First, regarding the inversion control of the scanning direction, the controller 61 outputs the direction signal DIRY, the value of which is inverted at a unit period cycle, to the scanning line driving circuit 104 and controls the output sequence of the scanning signals G1, G2, . . . , and Gm with respect to the scanning lines 3*a* in a forward direction or in a backward direction. That is, referring to the timing chart of FIG. 7, the direction signal DIRY is supplied such that '0' and '1' are repeated at the unit period cycle, so that the signal output sequence of the shift register 101A is inverted. As a result, the vertical scanning direction is inverted, as shown in FIG. 5.

Therefore, the vertical scanning direction is inverted for each screen. In addition, in the general driving method, the vertical scanning direction of the signals and the horizontal scanning direction of the signals are fixed and the image signals are written in the sequence from the upper side to the lower side, and thus display irregularities, such as dark spots, occur in the vertical direction. On the contrary, according to the present embodiment, the writing sequence of the image signals in the vertical direction is inverted for each unit period, so that the dark spots in the vertical direction are equalized on the time axis at the unit period cycle, thereby performing uniform display. In addition, even if the vertical scanning direction is inverted, in order to display a favorable image, an image signal D-12 in the unit period t2 is supplied to the data line 6*a* in a state in which the arrangement sequence of line data is inverted (see FIG. 8B). The details will be described below.

In addition, the double speed (2×) driving method is achieved by using the frame memories 62 and 63.

In FIG. 6, the same frame data D-1 in the sequentially input image signal DATA is written in the frame memories 62 and 63. In addition, the image signal D-12 of the frame memory 63 is read out after being delayed by a ½ frame period from the image signal D-11 of the frame memory 62 according to a vertical synchronizing signal Vsync' having a frequency that is obtained by multiplying the frequency of the vertical synchronizing signal Vsync by two. As a result, as shown in the timing chart of FIG. 7, in the image signals D-11 and D-12 indicating the same screen, the image signal D-12 is shifted by a ½ frame period with respect to the image signal D-11 to be overwritten in one frame period.

Here, the frame memory 62 is used as an example of 'a forward memory' of the invention and the frame memory 63 is used as an example of 'a backward memory' of the invention. The controller 61 controls the writing direction and the reading direction of the frame memory 62 such that the directions are always the same. Therefore, in the image signal D-11, the arrangement sequence of data is not changed before or after the writing and reading operations are performed through the frame memory 62 and the image signal D-11 is supplied to the data line 6*a* as it is. On the other hand, the controller 61 controls the writing direction and the reading direction of the frame memory 63, such that the directions are constantly inverted. Therefore, in the image signal D-12, the arrangement sequence of line data is changed before or after the writing and reading operations are performed through the frame memory 63.

FIGS. 8A and 8B show a specified example of the inversion operation sequence and relate to the frame memories 62 and 63, respectively. The writing direction and the reading direction are indicated by arrows in each frame memory. Here, the left side of the frame memory indicates the writing direction and the right side of the frame memory indicates the reading direction. As shown in FIG. 8A, in the frame memory 62, the image signal D-11 is allocated with an address in the sequence from the upper side to the lower side to be written and is read out in the address sequence (in the sequence from the upper side to the lower side). Thus, the arrangement of line data A, B, . . . , and E in the read image signal D-11 is in the sequence <A→E> according to the original sequence. In FIG. 8B, in the frame memory 63, line data of the image signal D-12 is allocated with an address in the sequence from the upper side to the lower side to be written. However, line data is read out in the inverted address sequence (in the sequence from the lower side to the upper side). Thus, the arrangement of line data A, B, . . . , and E in the read image signal D-12 is in the sequence <E→A> according to the sequence inverted with respect to the original sequence. For this reason, as shown in FIG. 5, when the horizontal scanning operation is performed in the sequence from the lower side to the upper side in the unit period t2, line data is supplied in the inverted sequence, so that a favorable image can be displayed.

As such, according to the present embodiment, since the horizontal scanning direction is inverted at the unit period cycle, the inconsistency, such as the dark spots in the vertical direction, caused by the fixed vertical scanning direction can be equalized, thereby performing uniform display. In addition, since the arrangement sequence of the image signals DATA is inverted according to the inversion of the scanning direction, a favorable image display can be performed.

In addition, according to the present embodiment, since the arrangement sequence of line data of the image signal DATA is inverted for every other screen by using the frame memories 62 and 63, 'the signal supply direction inversion driving method' according to the invention can be applied to the configuration of the double speed driving method. As a result, since the scanning frequency is 100 Hz larger than twice frequency of the input image signal, flicker can be prevented from being perceived by the human eye. Further, the display irregularities caused by 'the supply direction inversion driving method' can be suppressed.

Further, according to the present embodiment, a case in which the reading sequence by the frame memory 63 is inverted is described. However, even if the writing sequence is inverted, the data arrangement in the image signal can be inverted in the same manner as described above.

2: Second Embodiment

Figure 9:
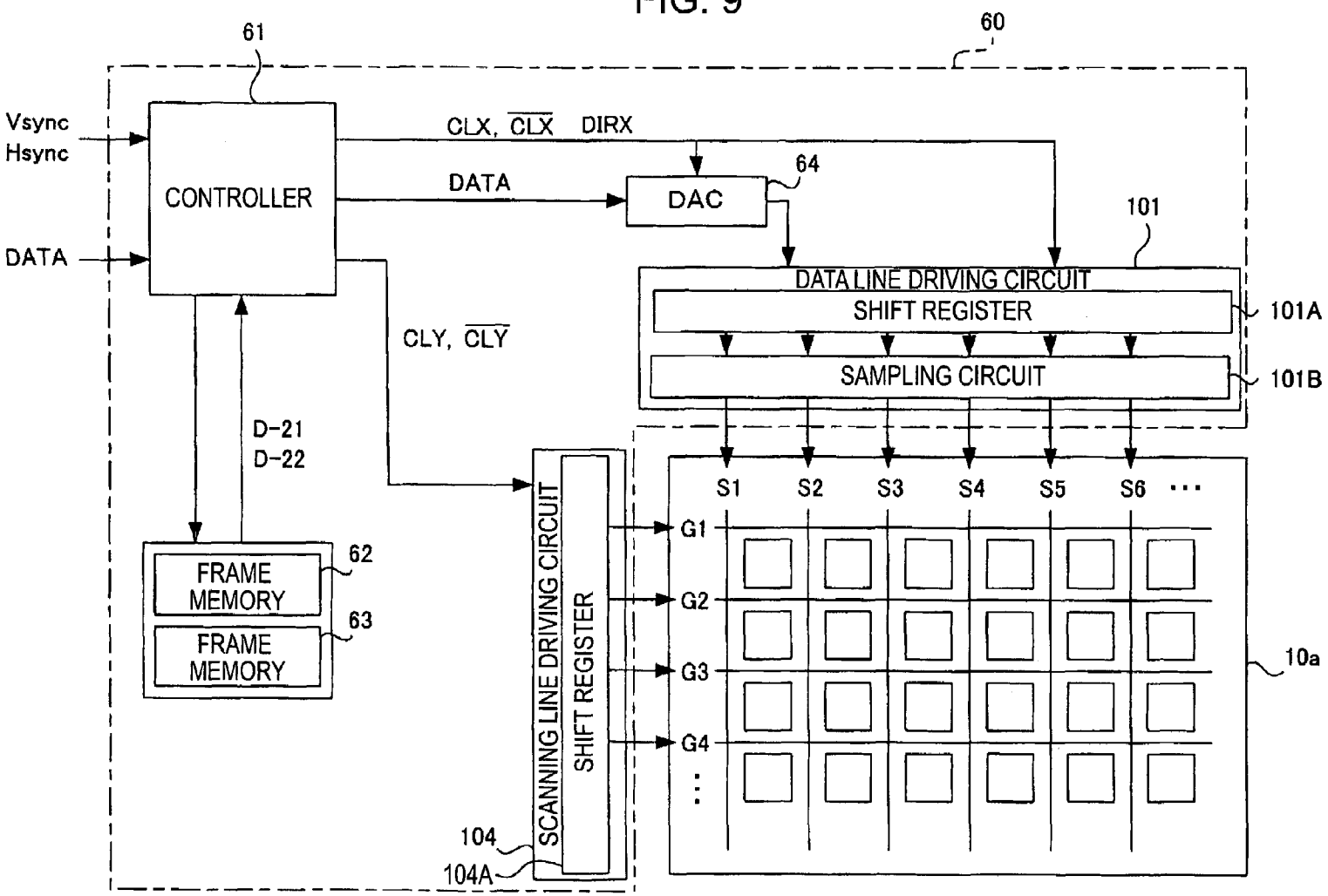
FIG. 9 is a block diagram showing a configuration of a driving system for an electro-optical device according to a second embodiment of the invention.
Figure 10:
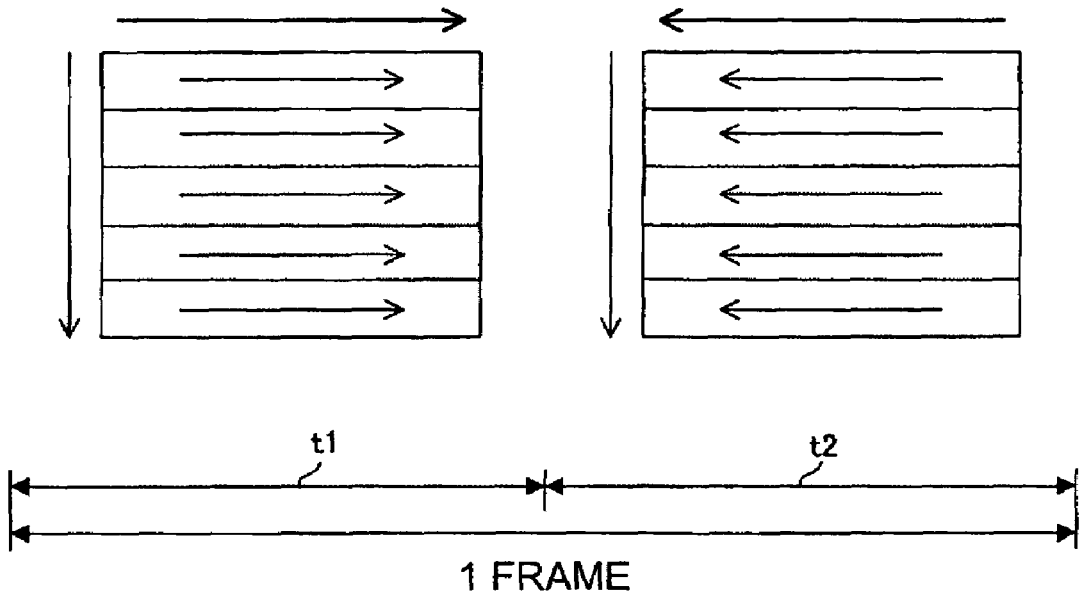
FIG. 10 is a diagram illustrating a method of driving an electro-optical device according to the second embodiment of the invention.
Figure 11:
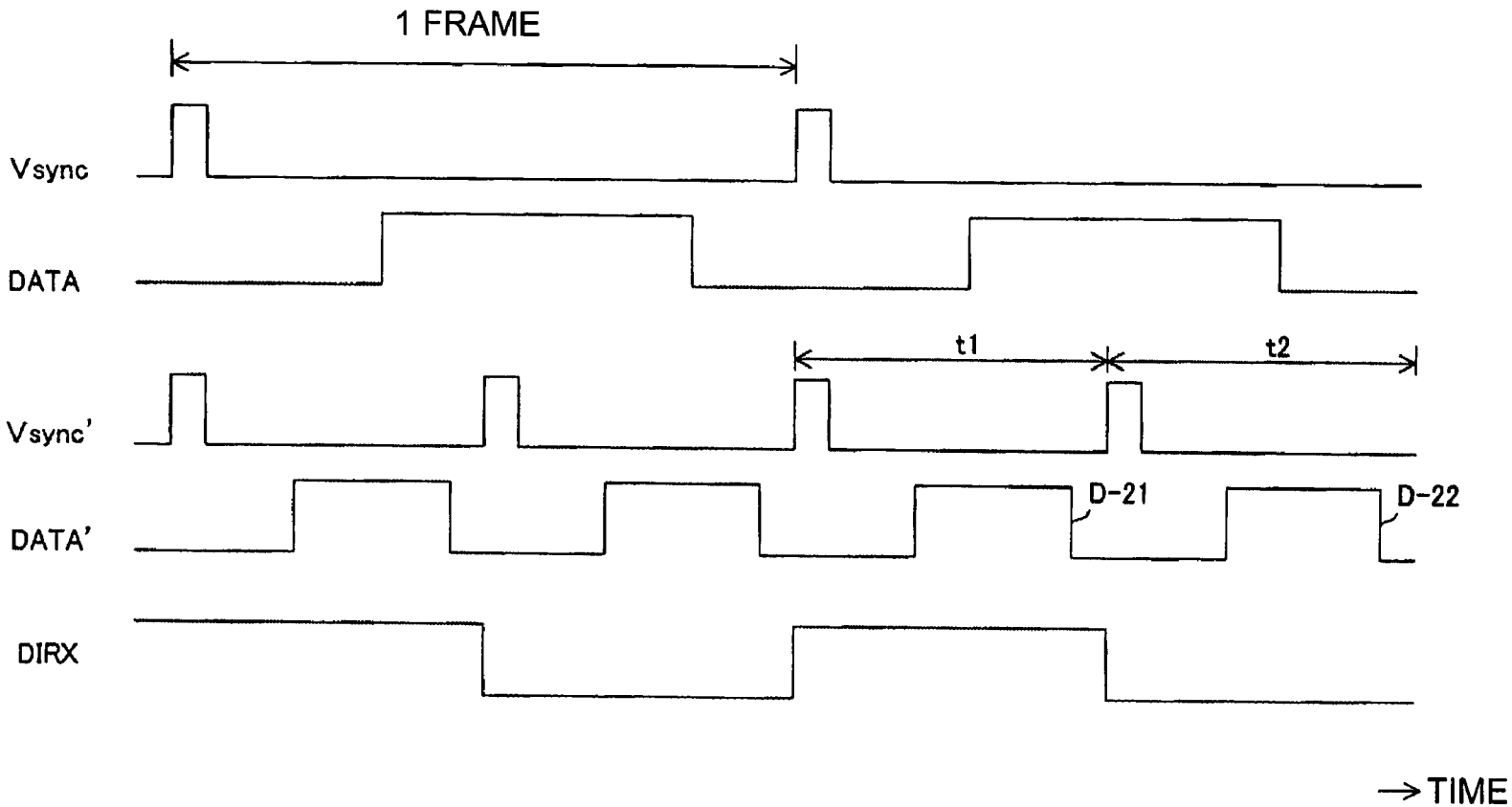
FIG. 11 is a timing chart illustrating the method of driving an electro-optical device according to the second embodiment of the invention.
Figure 12A:
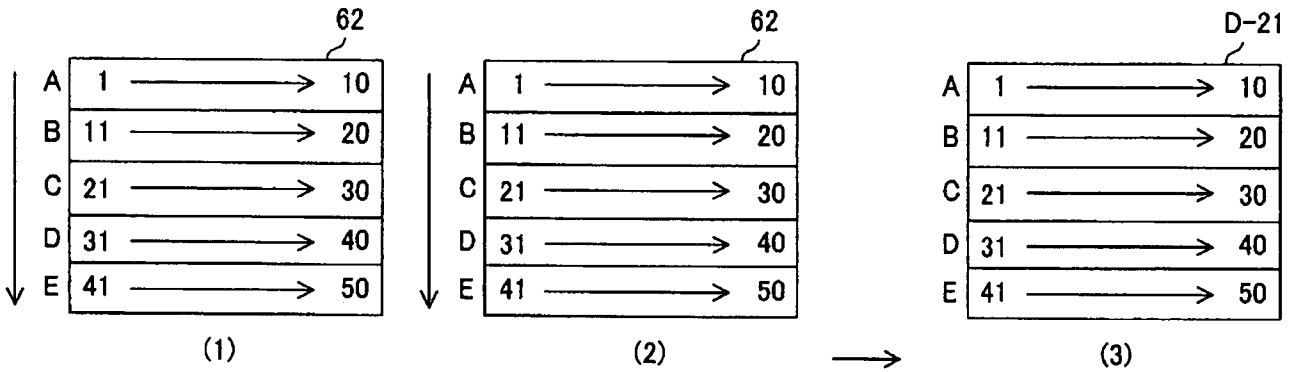
FIG. 12A is a diagram illustrating the method of driving an electro-optical device according to the second embodiment of the invention.
Figure 12B:
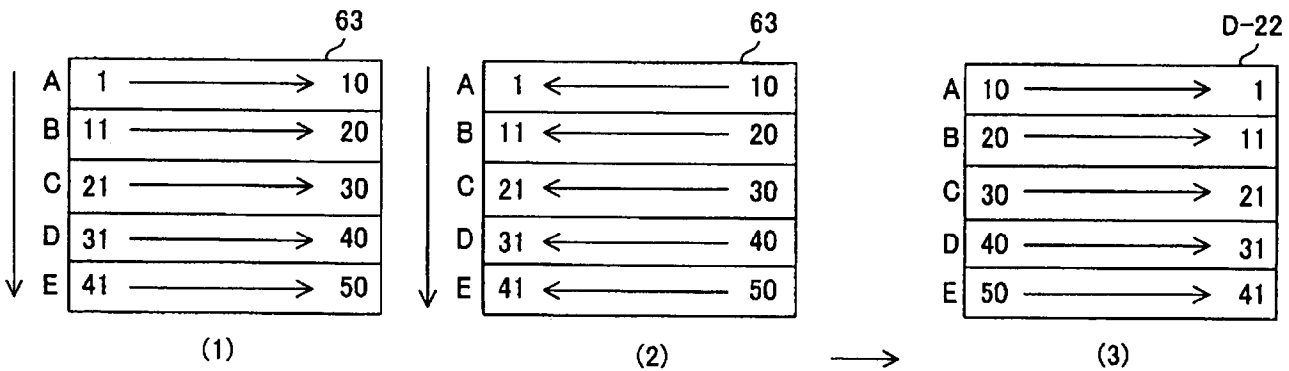
FIG. 12B is a diagram illustrating the method of driving an electro-optical device according to the second embodiment of the invention.

An electro-optical device according to a second embodiment of the invention will be described with reference to FIGS. 9 to 12B. FIG. 9 is a block diagram showing the configuration of a driving system including driving circuit units in the electro-optical device according to the second embodiment. FIG. 10 is a diagram conceptually showing a driving method according to the present embodiment. FIG. 11 is a timing chart according to the driving method of the present embodiment. FIGS. 12A and 12B are diagrams showing a sequence of a signal inversion process by frame memories 62 and 63. Moreover, the configuration and the driving method of the liquid crystal device according to the second embodiment are the same as those in the first embodiment. Thus, the same constituents as those in the first embodiment will be represented by the same reference numerals and the descriptions thereof will be omitted.

In the first embodiment, the driving method is described in which the image signal is written while the scanning signal supply sequence with respect to the scanning lines 3*a* at the time of vertical scanning (that is, vertical scanning direction) is inverted for each screen. However, in the second embodiment, a driving method is described in which the image signal supply sequence with respect to the data lines 6*a* at the time of horizontal scanning (horizontal scanning direction) is inverted for each screen. Also, in the second embodiment, the double speed driving method is performed.

In FIG. 9, a controller 61, which is an example of 'a control unit' according to the invention, has a function that controls the signal supply direction of a data line driving circuit 101 and a function that controls the reading direction of image signals DATA in the frame memories 62 and 63. The controller 61 inputs a direction signal DIRX to a data line driving circuit 101, instead of inputting a direction signal DIRY to a scanning line driving circuit 104, and controls the signal supply direction of image signals S1, S2, . . . , and Sn.

In the data line driving circuit 101, a transfer signal for controlling an output sequence of the image signals S1, S2, . . . , and Sn is generated by a built-in shift register 101A. According to the present embodiment, the shift register 101A is constructed such that the output sequence of the transfer signals is changed according to the direction signal DIRX. The direction signal DIRX is a control signal that changes the image signal supply direction to a direction from the right side to the left side in the arranged data lines 6*a* and a direction from the left side to the right side. In the data line driving circuit 101, a shift register start signal (not shown) according to the direction signal DIRX is inputted to the shift register. The shift register 101A is driven in a direction from the left end to the right end when the shift register start signal is inputted to the left end, and is driven in a direction from the right end to the left end when the shift register start signal is inputted to the right end. Since the output sequence of the image signals corresponds to the driving direction of the shift register 101A, with such a configuration, the controller 61 can control the output sequence of the image signals S1, S2, and Sn with respect to the data lines 6*a* in the data line driving circuit 101.

Next, a method of driving a liquid crystal device will be described.

As shown in FIG. 10, the liquid crystal device is driven such that the image signal supply sequence with respect to the plurality of data lines 6*a* (that is, horizontal scanning direction) is inverted for each screen. More particularly, in a unit period t1 of one frame period, the image signals are sequentially supplied in a direction from the left side of the screen to the right side thereof. However, in a unit period t2, the image signals are sequentially supplied in a direction from the right side of the screen to the left side thereof. The driving method can be achieved through the following process. The controller 61 outputs the direction signal DIRX, the value of which is inverted at a unit period cycle, to the data line driving circuit 101 so as to control the output sequence of the shift register 101A, that is, the output sequence of the image signals S1, S2, . . . , and Sn with respect to the data lines 6*a* in a forward direction or in a backward direction.

That is, as shown in the timing chart of FIG. 11, the direction signal DIRX is supplied such that '0' and '1' are repeated at the unit period cycle, so that the supply direction of the image signals S1, S2, . . . , and Sn is inverted, as shown in FIG. 10. In addition, in the unit period t1, the image signal D-21 read out from the frame memory 62 is supplied to the data line 6*a*, and, in the unit period t2, the image signal D-22 read out from the frame memory 63 is supplied to the data line 6*a*.

In addition, even if the supply direction of the image signals S1, S2, . . . , and Sn is inverted, in order to display a favorable image, the image signal DATA in the unit period t2 is supplied to the data line 6*a* in a state in which the arrangement sequence of the data in line data is inverted (see FIG. 12B). According a general driving method, the supply direction of line data in each horizontal scanning operation is fixed, and the display irregularities occurs, that is, the generation status of ghost is different in the vertical direction because of the application sequence of the image signals with respect to the data lines. On the contrary, according to the present embodiment, since the writing sequence of the image signals in the horizontal direction is inverted for each unit period, the dark spots in the horizontal direction are equalized on the time axis at the unit period cycle, thereby performing a uniform display.

In addition, the controller 61 controls the operations of the frame memories 62 and 63 as follows. In the frame memory 62, which is an example of 'a forward memory' according to the invention, the data writing direction and the data reading direction of line data are controlled to be constantly equal to each other. On the other hand, in the frame memory 63, which is an example of 'a backward memory' according to the invention, the data writing direction and the data reading direction of line data are controlled to be constantly inverted. As a result, the image signal D-21 written into the frame memory 62 is supplied to the data line 6*a* without changing the arrangement sequence of data before or after writing/reading. On the contrary, in the image signal D-22 written into the frame memory 63, the arrangement sequence of line data is changed before or after writing/reading.

FIGS. 12A and 12B show the inversion operation sequence in detail. FIGS. 12A and 12B relate to the frame memories 62 and 63. FIGS. 12A and 12B shows a data writing sequence in the frame memory, a data reading sequence in the frame memory, and a data arrangement of the image signal read out from the frame memory, respectively, from the left side of the drawing. Referring to FIG. 12A, in the frame memory 62, the image signal D-21 is allocated with an address in the sequence from the left side to the right side to be written and is read out in the address sequence (the sequence from the left side to right side). As a result, the data arrangement in the read image signal D-21 is in the original sequence. Referring to FIG. 12B, in the frame memory 63, line data A, B, . . . , and E of the image signal D-22 are allocated with an address in the sequence from the left side to the right side to be written. However, since line data is read out in the inverted sequence (the sequence from the right side to the left side), the data arrangement of line data A, B, . . . , and E in the read image signal D-22 is inverted from the original sequence. For example, as shown in FIGS. 12A and 12B, when line data is constructed such that line data A is data 1 to 10, line data B is data 11 to 20, . . . , line data is allocated with an address of the frame memory 63 in a data sequence described above to be written. In this case, the reading operation of line data is not performed in the inverted sequence. The data arrangement in line data is inverted such that line data A is in the sequence of data 10 to 1 and line data B is in the sequence of data 20 to 11. For this reason, as shown in FIG. 10, even though the horizontal scanning direction is inverted in the unit period t2, the data arrangement in line data is changed in the inverted sequence, thereby performing a favorable image display.

As such, according to the present embodiment, since the horizontal scanning direction is inverted at the unit period cycle, the inconsistency, such as the generation status of ghost not being constant in the horizontal direction, caused by the fixed vertical scanning direction can be equalized, thereby performing a uniform display. In addition, other effects and advantages are the same as those of the first embodiment.

3: Third Embodiment

Figure 13:
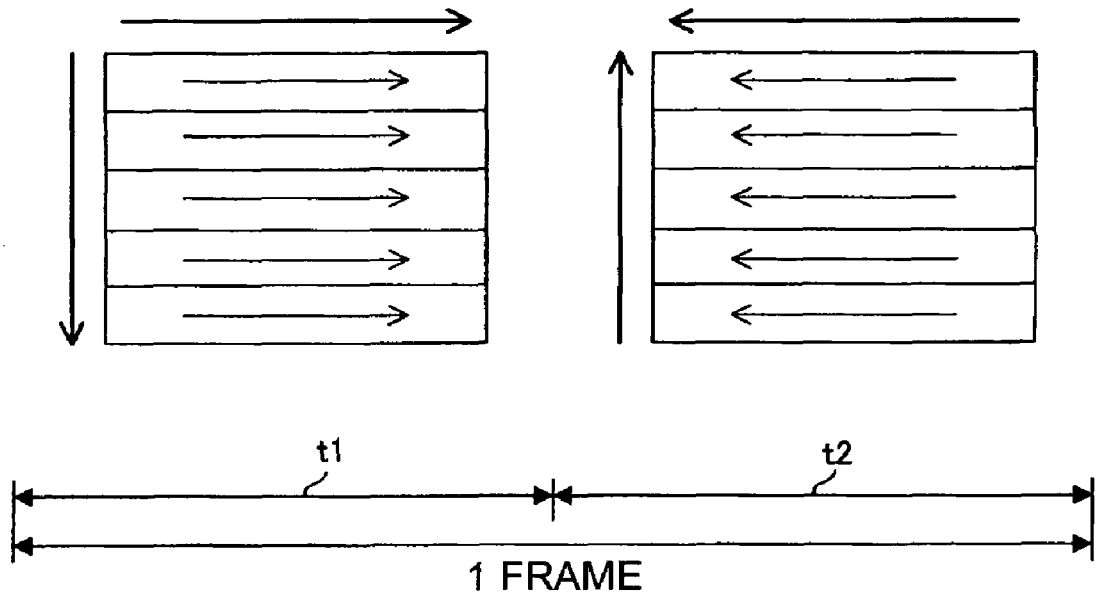
FIG. 13 is a diagram illustrating a method of driving an electro-optical device according to a third embodiment of the invention.
Figure 14A:
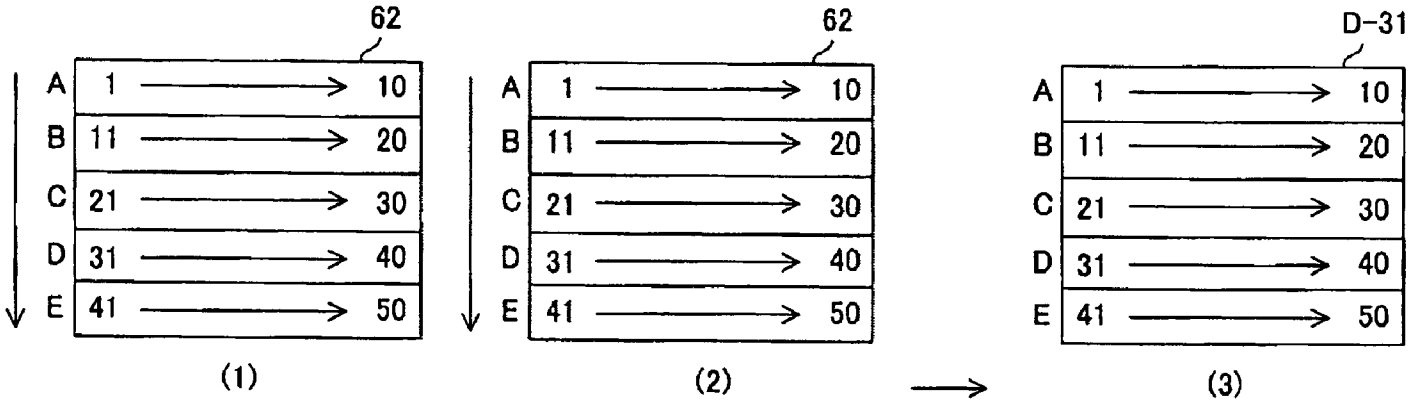
FIG. 14 is a diagram illustrating the method of driving an electro-optical device according to the third embodiment of the invention.
Figure 14B:
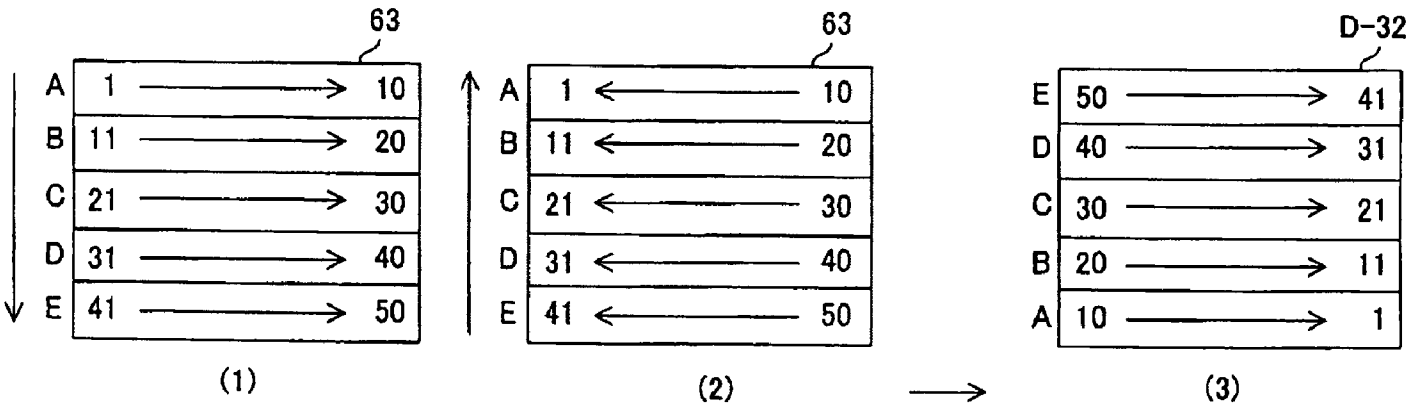

An electro-optical device according to a third embodiment of the invention will be described with reference to FIGS. 13 and 14B. FIG. 13 is a diagram conceptually showing a driving method according to the present embodiment. FIGS. 14A and 14B are diagrams illustrating a sequence of a signal inversion process by frame memories 62 and 63.

In FIG. 13, in a liquid crystal device according to the present embodiment, both a horizontal scanning direction and a vertical scanning direction are inverted for each screen when driving. This driving method can be achieved through the following process. The controller 61 outputs to the scanning line driving circuit 104 and the data line driving circuit 101 the direction signals DIRX and DIRY, the values of which are inverted at a unit period cycle. At this time, an output sequence of the shift register 104A (that is, the output sequence of the scanning signals G1, G2, . . . , and Gm with respect to the scanning lines 3*a* ) is controlled in a forward direction or in a backward direction according to the direction signal DIRY. In addition, an output sequence of the shift register 101A (that is, the output sequence of the image signals S1, S2, . . . and Sn with respect to the data lines 6*a*) is controlled in a forward direction or in a backward direction according to the direction signal DIRX. That is, the controller 61 has a function according to the first embodiment and a function according to the second embodiment.

In the same manner as the first embodiment, the liquid crystal device is driven at the double speed (2×) by using the frame memories 62 and 63. Here, in the unit period t1, the image signal D-31 read out from the frame memory 62 is supplied to the data lines 6*a*, and, in the unit period t2, the image signal D-32 read out from the frame memory 63 is supplied to the data lines 6*a*. As described above, in the unit period t2, the horizontal scanning direction and the vertical scanning direction are inverted according to the direction signals DIRX and DIRY. At this time, even if the supply direction of the image signals S1, S2, . . . , and Sn is inverted, in order to display a favorable image, the image signal D-32 in the unit period t2 is supplied to the data line 6*a* in a state in which the arrangement sequence of line data and the data arrangement sequence in line data are inverted.

Referring to FIG. 14A, in the frame memory 62, since the image signal D-31 is allocated with an address in the sequence from the upper side to the lower side to be written and is read out in the same address sequence (the sequence from the upper side to the lower side), the data arrangement in the read image signal D-31 is in the original sequence. On the other hand, referring to FIG. 14B, in the frame memory 63, line data of the image signal D-32 is allocated with an address in the sequence from the left side to the right side to be written. However, since line data is read out in the inverted address sequence (the sequence from the right side to the left side), the data arrangement sequence in line data of the read image signal D-32 is inverted from the original sequence.

For example, line data A, B, C, D, and E of the image signal D-32 is allocated with an address of the frame memory 63 in that sequence. However, by reading the address in an inverted direction, the arrangement of line data is inverted in the sequence of line data E, D, C, B, and A. As shown in FIGS. 14A and 14B, when line data is constructed such that line data A is in the sequence of data 1 to 10, line data B is in the sequence of data 11 to 20, . . . , line data is allocated with an address of the frame memory 63 in that sequence to be written. However, by reading the address in an inverted sequence, the data arrangement in line data is inverted such that line data A is constructed in the sequence of data 10 to 1, line data B is constructed in the sequence of data 20 to 11, . . . . For this reason, as shown in FIG. 13, even though both the horizontal scanning direction and the vertical scanning direction are inverted in the unit period t2, the arrangement of line data and the data arrangement in line data are inverted, thereby displaying a favorable image.

As such, according to the present embodiment, since the horizontal scanning direction and the vertical scanning direction are inverted at the unit period cycle, the effects and advantages according to the third embodiment are the same as those of the first and second embodiments.

4: Fourth Embodiment

Figure 15:
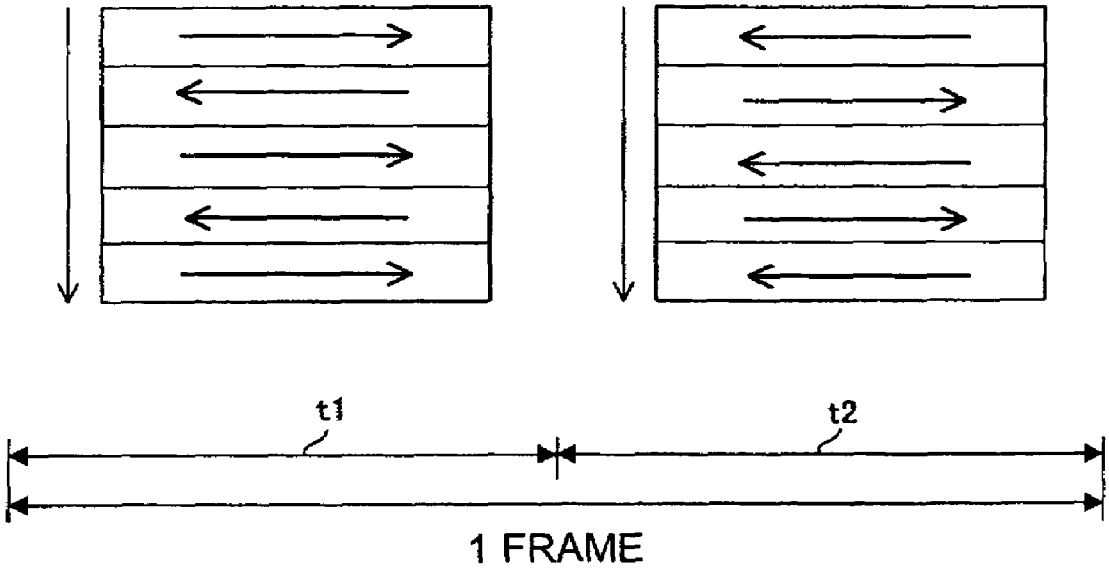
FIG. 15 is a diagram illustrating a method of driving an electro-optical device according to a fourth embodiment of the invention.
Figure 16:
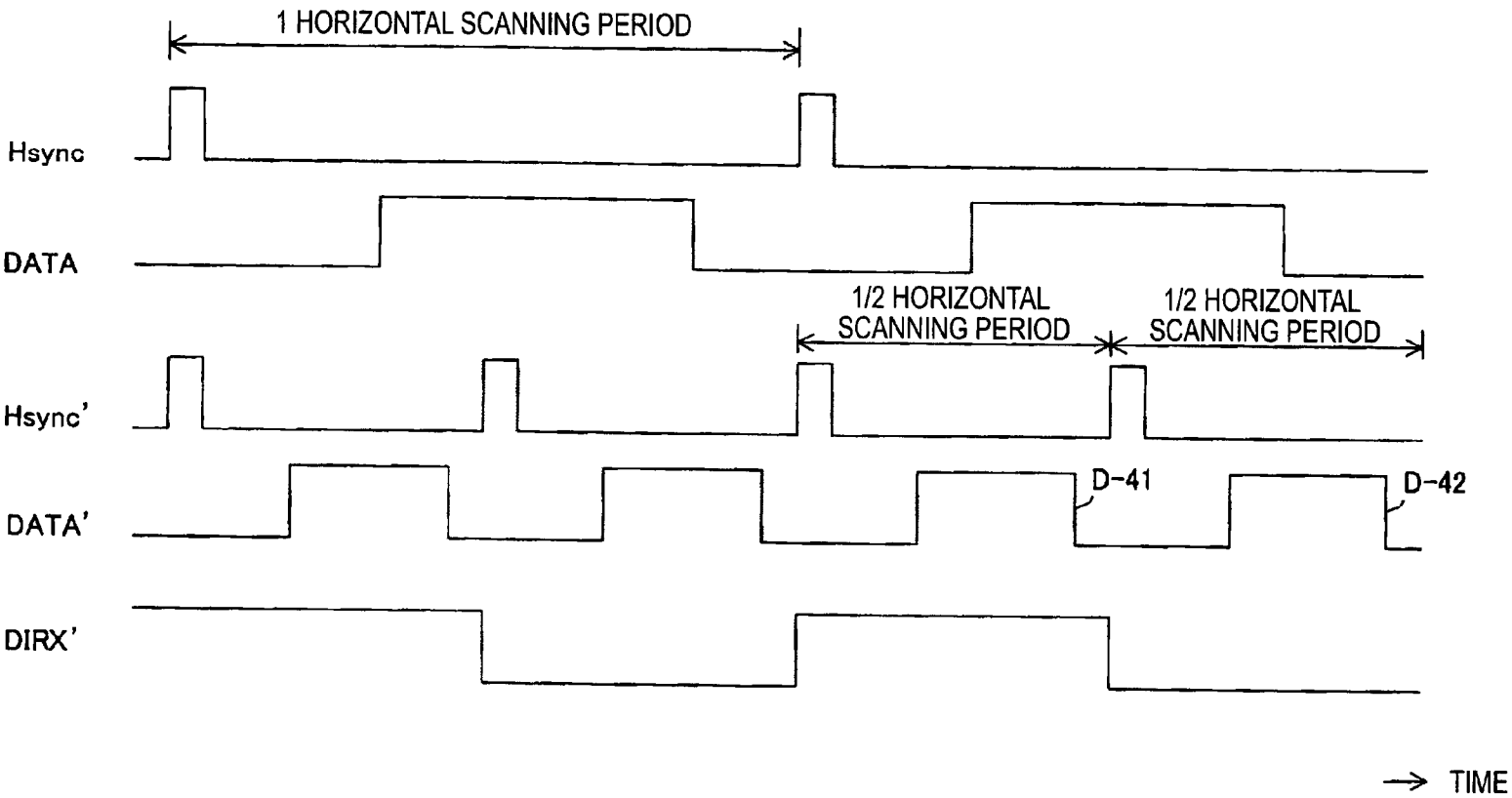
FIG. 16 is a timing chart illustrating the method of driving an electro-optical device according to the fourth embodiment of the invention.
Figure 17A:
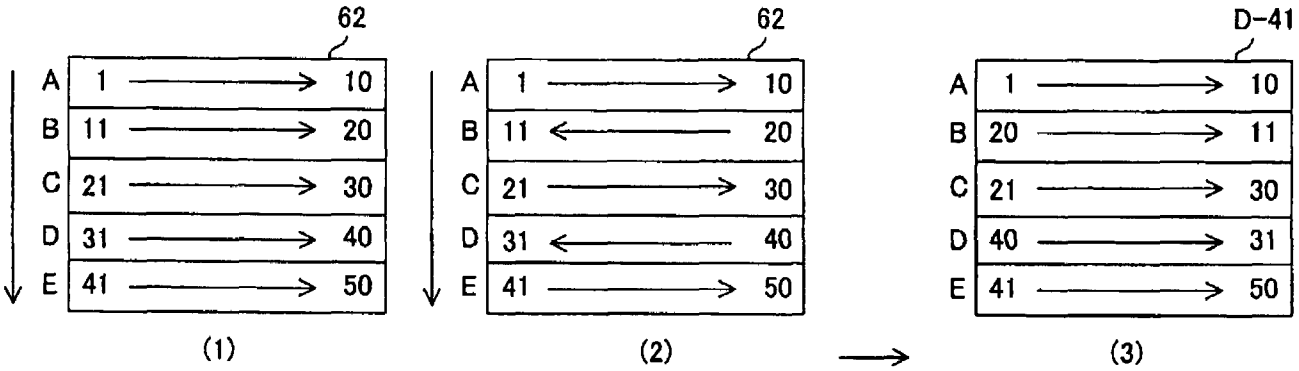
FIG. 17 is a diagram illustrating the method of driving an electro-optical device according to the fourth embodiment of the invention.
Figure 17B:
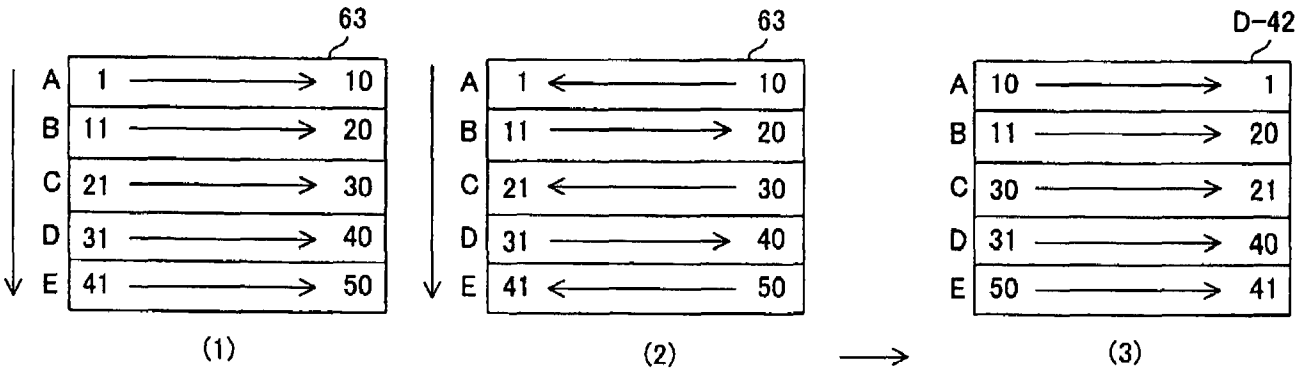

An electro-optical device according to a fourth embodiment of the invention will be described with reference to FIGS. 15 to 17B. FIG. 15 is a diagram conceptually showing a driving method according to the present embodiment. FIG. 16 is a timing chart according to the driving method of the present embodiment. FIGS. 17A and 17B are diagrams illustrating a sequence of a signal inversion process by frame memories 62 and 63.

In FIG. 15, a liquid crystal device according to the present embodiment inverts a horizontal scanning direction for each line when driving. In addition, the liquid crystal device inverts the respective lines for each unit period and is driven such that the horizontal scanning direction of the respective lines is different in the unit period t1 and in the unit period t2. This driving method can be achieved through the following process. The controller 61 outputs a direction signal DIRX', the value of which is inverted for each horizontal scanning period, to the data line driving circuit 101, instead of the direction signal DIRX in the second embodiment (see FIG. 9). In addition, like the above-mentioned embodiments, the liquid crystal device is driven at a double speed (2×) by using the frame memories 62 and 63.

In FIG. 16, the direction signal DIRX' is outputted in accordance with a horizontal synchronizing signal Hsync' having a frequency, which is obtained by multiplying a frequency of a horizontal synchronizing signal Hsync by two. In addition, in accordance with the direction signal DIRX', the output sequence of the shift register 101A (that is, the output sequence of the image signals S1, S2, . . . and Sn with respect to the data lines 6*a*) is controlled in a forward direction or in a backward direction for each horizontal scanning operation.

At this time, even if the signal supply direction of the image signals S1, S2, . . . , and Sn is inverted, in order to display a favorable image, the image signal DATA serving as frame data supplied for each unit period is supplied to the data line 6*a* in a state in which the arrangement sequence of line data is alternately inverted for each line. For this reason, the controller 61 controls the operations of the frame memories 62 and 63 as follows.

Referring to FIG. 17A, in the frame memory 62, the image signal D-41 is allocated with an address in the sequence from the upper side to the lower side to be written, and line data is allocated with an address in the sequence from the left side to the right side to be written. In addition, since only even-numbered line data B and D are read out in an inverted address sequence (the sequence from the right side to the left side), in the data arrangement of the read image signal D-41, the data arrangement of odd-numbered line data A, C, and E is in the original sequence. However, the data arrangement in even-numbered line data B and D is inverted from the original sequence.

In addition, referring to FIG. 17B, in the frame memory 63, the writing operation is performed in the same manner as that in the frame memory 62. However, the reading operation is performed in a sequence inverted from the above-described sequence, the data arrangement of odd-numbered line data A, C and E is inverted from the original sequence, and the data arrangement of even-numbered line data B and D is in the original sequence. Further, the data arrangement in the read image signal D-41 can be made by using a line memory. Line data is read out from the frame memory in the original sequence to be sequentially written in the line memory. For example, whenever line data is written once or is read out once, the address sequence is inverted at the time of the writing operation to the line memory or at the time of the reading operation.

As such, according to the present embodiment, since the horizontal scanning direction is inverted at a line cycle, the dark spots in the vertical direction, such as the generation status of ghost, can be spatially equalized, thereby performing the uniform display. The effects and advantages according to the fourth embodiment are the same as those of the first and second embodiments.

As described above, according to the above-mentioned embodiments, for convenience, the polarity of the image signal is ignored. However, in the liquid crystal device, the polarity inversion driving method, such as a surface inversion driving method, may be simultaneously performed. In a general surface inversion driving method, flicker may occur at a polarity inversion cycle, such that luminance in the positive polarity screen and luminance in the negative polarity screen are the same due to the characteristics of the TFT. However, the inconsistency can be suppressed by performing the double speed driving method. In addition, since a large electric charge leaks from the pixel unit, in which the time the potential of the data line and the potential of the pixel electrode maintained different to each other in polarity is long, the dark spots occur at the time of polarity inversion driving. However, the dark spots caused by the polarity inversion driving method can be improved by a driving method according to the invention in which the scanning direction is temporally or spatially inverted. In addition, the screen may be divided into a plurality of partial surfaces in a direction in which the scanning lines extend. Further, the polarity of even-numbered partial surfaces and the polarity of odd-numbered partial surfaces may be inverted at a complementary cycle.

In addition, one frame period is divided into two unit periods t1 and t2. Alternatively, one frame period may be divided into a plurality of unit periods (t1, t2, . . . , and tn) (where n is a natural number), and the liquid crystal device may be driven at the n speed (n×).

5: Electronic Apparatus

Figure 18:
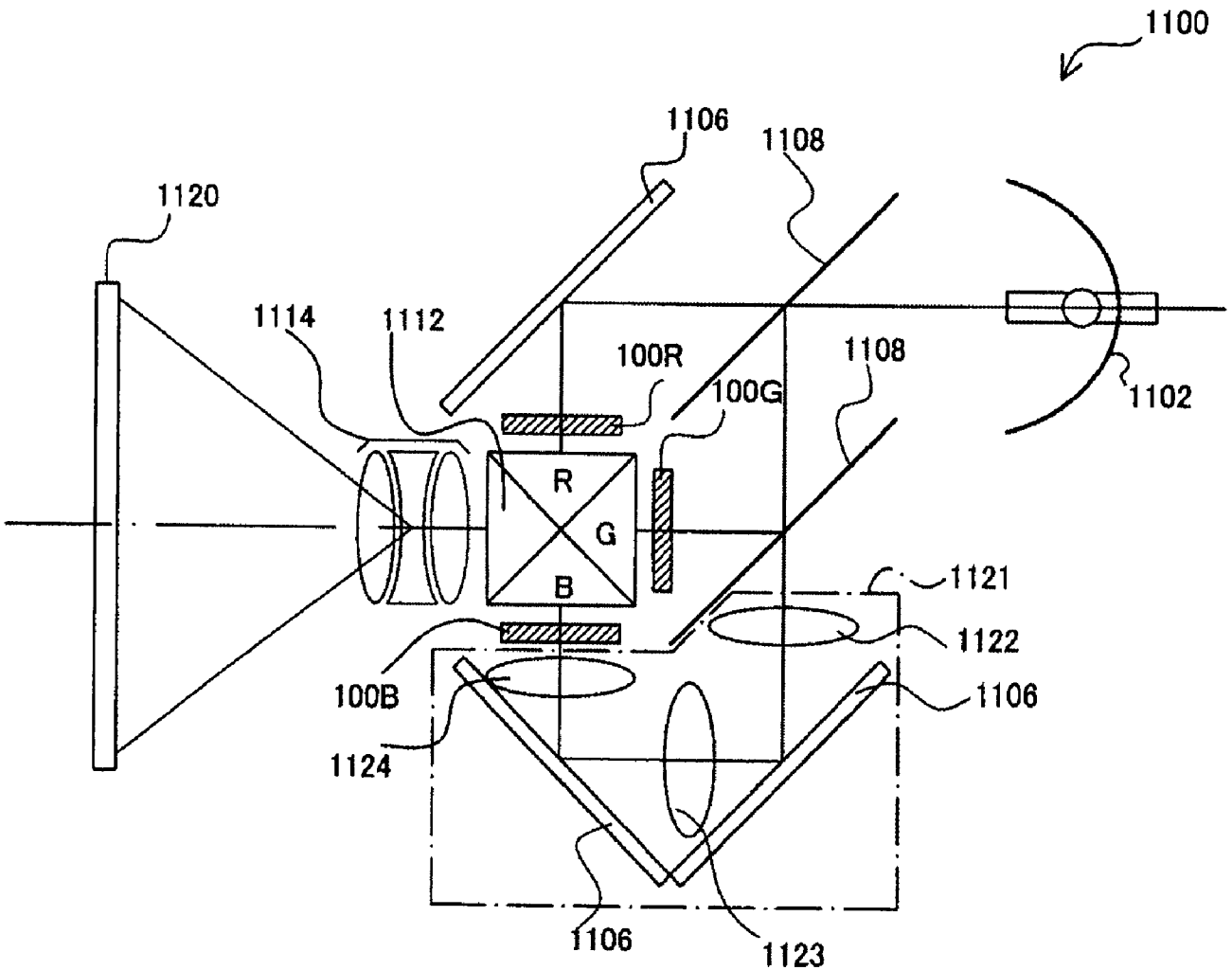
FIG. 18 is a schematic cross-sectional view showing an example of an electronic apparatus to which an electro-optical device according to an embodiment of the invention is applied.

Next, one specified example of a projection-type color display device which is an example of an electronic apparatus will be described with reference to FIG. 18. In this case, the above-mentioned electro-optical device is used as a light valve. FIG. 18 is a cross-sectional view schematically showing the projection-type color display device.

In FIG. 18, a liquid crystal projector 1100, which is an example of the projection-type color display device, has a configuration such that three liquid crystal modules using the liquid crystal device according to any one of the first to third embodiments are arranged and are constructed as light valves 100R, 100G, and 100B for red (R), green (G), and blue (B). In the liquid crystal projector 1100, light emitted from a lamp unit 1102 having a white light source, such as a metal halide lamp, is divided into a red (R) light component, a green (G) light component, and a blue (B) light component corresponding to three primary colors of R, G, and B to be guided to the light valves 100R, 100G, and 100B corresponding to the respective colors. At this time, the blue (B) light component is guided through a relay lens system 1121 having an incident lens 1122, a relay lens 1123, and an emitting lens 1124, so as to prevent light loss. In addition, the light components corresponding to the three primary colors which are respectively modulated through the light valves 100R, 100G, and 100B are synthesized by a dichroic prism 1112, and then are enlarged and projected as a color image onto a screen 1120 through a projection lens 1114.

In the projection-type color display device, the electro-optical device according to any one of the above-mentioned embodiments is used, so that noise, such as flicker, can be drastically reduced, thereby performing a uniform display.

The invention is not limited to the above-mentioned embodiments, and various changes and modifications may be made without departing from the spirit and scope of the invention read from the overall claims and specification. Further, a driving circuit of an electro-optical device, a method of driving the electro-optical device, the electro-optical device, and an electronic apparatus, which are accompanied with the various changes and modifications, still fall within the technical scope of the invention.

For example, in the above-mentioned embodiments, the active-matrix-type liquid crystal device using the TFTs is exemplified, but the invention is not limited thereto. For example, a TFD (thin film diode) may be used for a pixel switching element, and the invention may be applied to a passive-matrix-type liquid crystal device. In addition, the invention may be applied to an electro-optical device that a matrix driving method can be performed and display spots may occur due to the scanning direction, in addition to the liquid crystal device. The electro-optical device may be, for example, organic EL devices, electrophoretic devices, such as electronic papers, and display devices using electronic emission elements (Field Emission Display and Surface-Conduction Electron-Emitter Display).

What is claimed is:

1. A driving circuit for an electro-optical device which drives an electro-optical device having a plurality of data lines and a plurality of scanning lines extending so as to cross each other and a plurality of pixel units connected to the scanning lines and the data lines to form a display surface, the driving circuit for an electro-optical device comprising:

a memory into/from which image signals are written/read, the image signals being for performing gray scale display in the plurality of pixel units;

a scanning line driving unit that selects the scanning lines and supplies scanning signals to the selected scanning lines;

a data line driving unit that selects the data lines and supplies the image signals read out from the memory to the selected data lines;

a control unit that controls and operation of a least one of the scanning line driving unit and the data line driving unit, such that at least one of a selection sequence of the plurality of scanning lines and a selection sequence of the plurality of data lines is reversed at a predetermined cycle, and that controls writing and reading of the image signals in the memory, such that the image signals written into the memory are read out in a state in which an arrangement sequence of the image signals is reversed at the predetermined cycle, wherein the scanning line driving unit and the data line driving unit supply the image signals corresponding to one screen to the respective pixel units in each unit period, which is obtained by dividing a one-screen display period, and drives the respective pixel units multiple times in the one-screen display period, and wherein the memory has at least two frame memories, the same image signals corresponding to one screen are written into the two frame memories, and the two frame memories are controlled by the control unit, such that one of the frame memories functions as a forward memory from which the image signals are read out in a state in which the arrangement sequence of the image signals is in a forward direction, and the other frame memory functions as a backward memory from which the image signals are read in a state in which the arrangement sequence of the image signals is in a backward direction.

2. An electro-optical device comprising:

the driving circuit for an electro-optical device according to claim 1;

a plurality of data lines and a plurality of scanning lines; and a plurality of pixel units.

3. An electronic apparatus comprising the electro-optical device according to claim 2.

4. The driving circuit for an electro-optical device according to claim 1.

wherein the predetermined cycle is expressed in one-screen display periods.

5. The driving circuit for an electro-optical device according to claim 1, wherein, when a scanning signal supply direction is reversed, the predetermined cycle is expressed in horizontal scanning periods.

* * * * *